United States Patent [19]

Garay et al.

[11] Patent Number: 4,959,028

[45] Date of Patent: Sep. 25, 1990

[54] ELECTRICAL POWER CONNECTOR

[75] Inventors: Antonio A. Garay, Roselle; Tedford H. Spaulding, Chicago; Robert L. Valleau, Des Plaines, all of Ill.

[73] Assignee: Switchcraft Inc., Chicago, Ill.

[21] Appl. No.: 336,488

[22] Filed: Apr. 12, 1989

[51] Int. Cl.[5] ..... H01R 13/41

[52] U.S. Cl. ..... 439/733; 29/845

[58] Field of Search ..... 439/733, 736, 751, 752; 29/845

[56] References Cited

U.S. PATENT DOCUMENTS 2,966,651 12/1960 von Holtz ..... 439/733 X

*Primary Examiner*—Eugene F. Desmond

*Attorney, Agent, or Firm*—William R. Clark; Richard M. Sharkansky

[57] ABSTRACT

An electrical connector comprising a dielectric body including a housing having therein an open-ended cavity with an opposing closed end formed of a contact support wall of the housing. The wall has extended through its thickness a plurality of laterally spaced holes which communicate with respective aligned channels in the outer surface of the wall. Each of the through-holes has a defining surface from which protrudes integrally a ripple-like projection extending linearly from adjacent the outer surface of the wall toward the cavity. Each of the channels has opposing side surfaces from which protrude integrally respective ripple-like projections having spaced opposing crest portions. The holes are dimensioned for having press-fitted therein contact engaging arms of respective right-angle contact members which compress the respective ripple-like projections in the holes and are pressed against respective opposing surfaces thereof. The channels are dimensioned for having press-fitted therein channel engaging arms of the respective contact members which shave off the opposing crest portions of the respective ripple-like projections therein. The crest portion shavings are deposited in respective trough-like slots in the bottom surfaces of the respective channels to allow the respective channel engaging arm to bottom therein. The dielectric body includes a plate-like cover which is fitted over the channels and holes, and fixedly attached to the outer surface of the connector wall.

12 Claims, 1 Drawing Sheet

ELECTRICAL POWER CONNECTOR

BACKGROUND OF THE INVENTION

1. Field of the Invention

This invention relates generally to electrical connectors and is concerned more particularly with an electrical power connector having means for aligning and retaining electrical contacts in respective desired positions in the connector body.

2. Discussion of the Prior Art

An electrical power connector of the receptacle type may comprise a dielectric body defining an open cavity having therein a plurality of male contacts which extend from a bottom wall of the cavity in laterally spaced relationship with one another. Thus, a mating electrical connector of the plug-in type may have a projecting dielectric portion which is insertable into the cavity of the receptacle type connector and which has a leading surface provided with a plurality of laterally spaced holes. Each of the holes is disposed for receiving therein an aligned male contact in the cavity, and supports a respective female contact for rubbing electrical engagement with the received male contact of the receptacle type connector.

Therefore, it is important that the male contacts of the receptacle type connector be positioned accurately in the cavity for alignment with respective holes in the leading surface of the plug-in type connector. Also, it is important that the male contacts of the receptacle type connector be firmly held in the respective desired positions for withstanding the insertion forces exerted by the rubbing female contacts of the plug-in type connector. Consequently, the male contacts of the receptacle type connector generally have respective supported portions fixedly embedded, as by molding, for example, in the bottom wall of the cavity.

However, it has been found that the time interval allowed for the operation of assembling contact members into molds prior to the molding operation is a limiting factor in reducing the overall time interval required for the molding process. Also, it has been found that the time interval required for the molding operation generally limits the time interval allowed for the operation of assembling contact members into molds for the next molding operation. Therefore, with the operation of assembling contact members into molds combined with the operation of molding the connector bodies, it is difficult to reduce the cost of either operation and thereby reduce the cost of producing each power connector.

SUMMARY OF THE INVENTION

Accordingly, these and other disadvantages of the prior art are overcome by this invention providing an electrical connector with a dielectric body which is fabricated independently of electrical contact members and includes means for subsequently having a plurality of electrical contact members mounted in respective firmly retained positions in the body. Thus, a large number of these dielectric bodies may be mass produced by conventional techniques, such as injection molding, for example, and stored for later having electrical contact members mounted therein to assemble a corresponding large number of the electrical connectors.

The dielectric body of this connector includes a housing having a contact support wall with an outer surface provided with a plateau region, and includes a cover which is fitted over the plateau region for fixedly securing the cover to the contact support wall. The plateau region has disposed therein a plurality of contact receiving channels which are substantially linear and spaced laterally apart. The contact receiving channels are aligned with and terminate in respective contact receiving holes which extend through the contact support wall and communicate with a cavity within the housing. Thus, each of the channels may have press-fitted therein a supported portion of a respective right angled contact member which has an orthogonal, contact engaging end portion forcefully inserted through the aligned contact receiving hole and into the cavity in the housing.

Each of the contact receiving channels has a width slightly greater than the thickness of the supported portion of the respective contact member press-fitted therein. Also, each of the channels has opposing side surfaces from which protrude integrally respective ripple-like projections which extend orthogonally of the channel. The ripple-like projections have respective crest portions disposed in opposing relationship and spaced apart a distance less than the thickness of the supported portion of the respective contact member. Thus, the opposing ripple-like projections in the channel are dimensioned for interference engagement with the supported portions of the respective contact member which compresses and may even shave off crest portions of the opposing ripple-like projections. As a result, the opposing ripple-like projections exert respective lateral pressures on adjacent side surfaces of the supported portion for retaining the respective contact member firmly in the channel and for aligning the contact engaging end portion of the contact member in a respective desired plane within the cavity.

Moreover, each of the contact receiving holes has a size conforming closely to the size of the contact engaging end portion of the respective contact member inserted forcefully through it into the cavity. Also, each of the contact receiving holes may have a defining lower or upper surface provided with an integral ripple-like protrusion which extends linearly in the direction of the inserted contact engaging end portion of the respective contact member. The ripple-like protrusion is dimensioned for pressure engagement with an adjacent surface of the contact engaging end portion when the contact engaging end portion is inserted forcefully through the contact receiving hole. As a result, the contact engaging end portion of the respective contact member is pressed against the opposing defining surface of the contact receiving hole thereby positioning the contact engaging end portion in the desired plane in the cavity.

Thus, a large number of the dielectric bodies may have the contact members rapidly installed therein, as by an automatic feed press, for example. Since the ripple-like projections provided in the channels automatically align the contact engaging end portions of the respective contact members in desired planes in the cavities of the housings, the assembled connectors will have their contact members spaced laterally apart appropriate distances for electrical engagement with respective aligned contacts of mating connectors. Also, the contact members installed in the dielectric bodies will be retained firmly in position while respective covers are fitted over the plateau regions and fixedly secured, as by ultrasonic bonding, for example, to the outer surfaces of the contact support walls of the assembled connectors.

BRIEF DESCRIPTION OF THE DRAWINGS

For a better understanding of the disclosed invention, reference is made in the following detailed description to the accompanying drawing wherein.

DESCRIPTION OF THE PREFERRED EMBODIMENT

Figure 1:
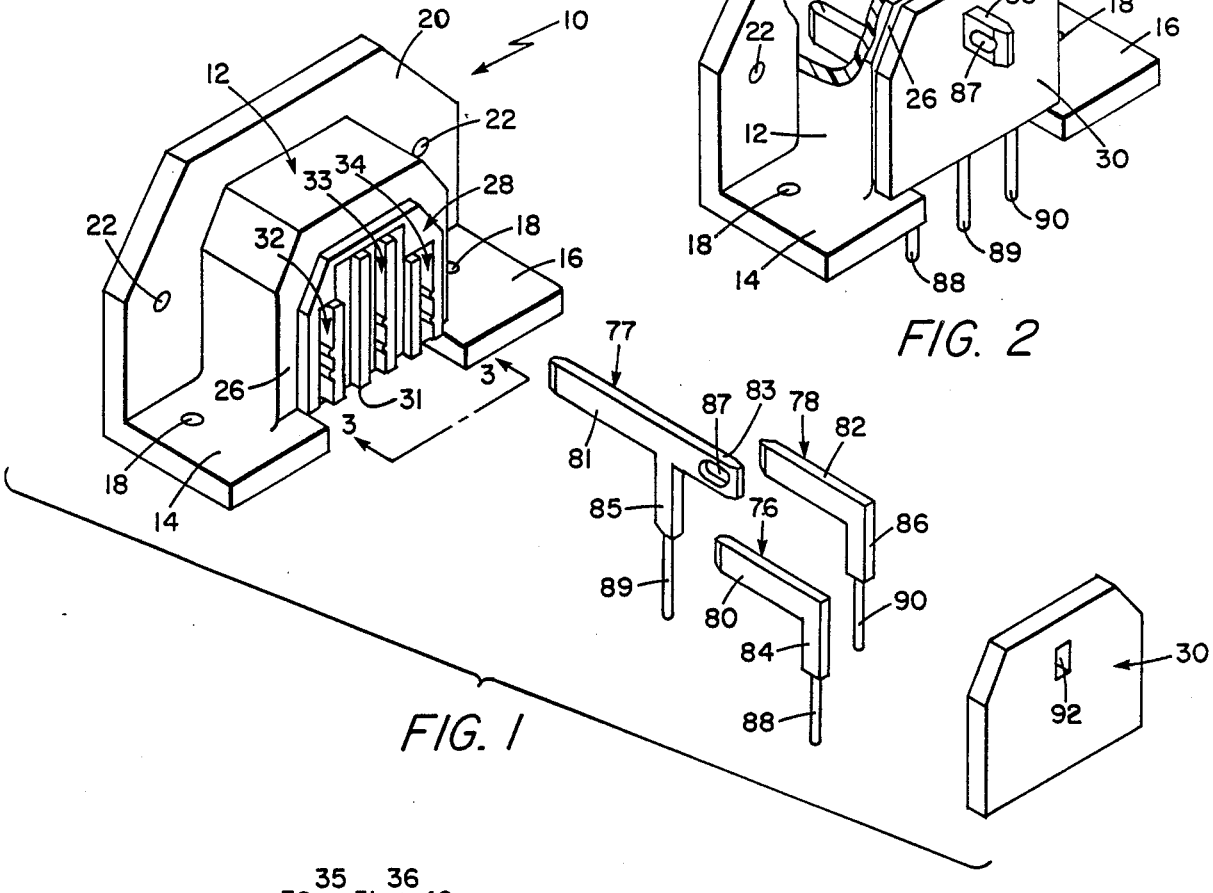
FIG. 1 is an isometric exploded view of an electrical power connector of the receptacle type embodying the invention.
Figure 2:
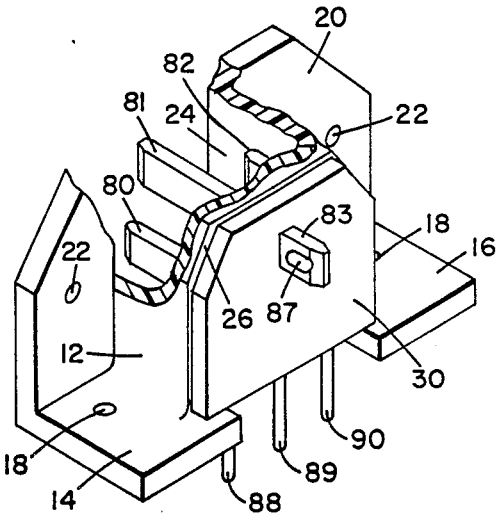
FIG. 2 is an isometric view, partly fragmentary, of the assembled connector shown in FIG. 1.

Referring to the drawing wherein like characters of reference designate like parts, there is shown in FIGS. 1 and 2 an electrical power connector 10 of the receptacle type having a dielectric body including a box-like housing 12. Housing 12 may be made of a molded plastic material, such as polycarbonate material, for example. Opposing side portions of the housing 12 may be integrally joined to respective support flanges 14 and 16 which extend laterally outward therefrom in substantially coplanar relationship with one another. The support flanges 14 and 16 may be provided with respective mounting holes 18 for securing the connector 10 to a support member (not shown), such as a printed circuit board, for example. Also, the support flanges 14 and 16 may be integrally joined to respective end portions of a connector flange 20 having therein respective through holes 22 for securing to the connector 10 a mating electrical connector, (not shown) such as a power connector of the plug-in type, for example.

The connector flange 20 extends in the lateral direction from an end portion of housing 12 defining an open end of a cavity 24 which is disposed within the housing. Housing 12 has a plurality of closed side walls defining respective sides of the cavity 24 and has a contact supporting wall 26 defining a bottom of the cavity 24. The contact support wall 26 has an outer surface provided with a plateau region 28 over which is fitted a dielectric cover 30 for securing it fixedly to the contact support wall 26. The cover 30 constitutes a component part of the dielectric body of connector 10 and may be made of molded plastic material, such as polycarbonate material, for example.

Figure 3:
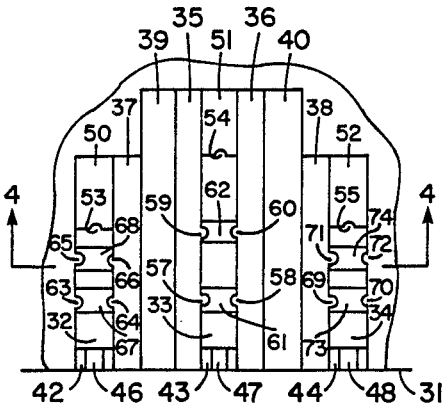
FIG. 3 is a fragmentary enlarged elevational view of the plateau region taken along the line 3—3 shown in FIG. 1 and looking in the direction of the arrows.

The plateau region 28 has adjacent the respective support flanges 14 and 16 an end surface 31 from which, as shown more clearly in FIG. 3, a longitudinally central channel 33 extends linearly a predetermined length in the outer surface of plateau region 28. Central channel 33 is disposed between two substantially parallel and coextensive ridges, 35 and 36, respectively, which protrude integrally from the outer surface of plateau region 28 respective similar distances. The ridges 35 and 36 have respective side surfaces disposed substantially coplanar with the adjacent side surfaces of channel 33 and comprises respective extensions thereof. Also, the ridges 35 and 36 terminate in respective outer surfaces having therebetween an opening which overlies and provides access to the channel 33. Ridges 35 and 36 are disposed between two substantially parallel and coextensive recessed areas, 39 and 40, respectively, which extend below the outer surface of plateau region 28 to respective similar depths. The recessed areas 39 and 40 have respective side surfaces disposed substantially coplanar with the adjacent side surfaces of ridges 35 and 36, respectively.

The recessed areas 39 and 40 are disposed between two substantially parallel ridges, 37 and 38, respectively, which protrude integrally from the outer surface of plateau region 28 respective distances similar to one another and to the protrusion distances of the respective ridges 35 and 36. Ridges 37 and 38 have respective similar lengths which are less than the lengths of ridges 35 and 36, respectively, and have respective side surfaces disposed substantially coplanar with the adjacent side surface portions of recessed areas 39 and 40, respectively. The ridges 37 and 38 are disposed between two substantially parallel and coextensive channels, 32 and 34, respectively, which have side surfaces disposed substantially coplanar with the adjacent side surfaces of ridges 37 and 38, respectively. The channels 32 and 34 extend from the end surface 31 linearly in the outer surface of plateau region 28 and have respective similar lengths which are less than the predetermined length of central channel 33. Thus, the central channel 33 is disposed between the two laterally spaced channels 32 and 34, respectively, which may have respective widths and depths similar to the width and depth of central channel 33.

The end portions of channels 32, 33 and 34 adjacent the end surface 31 of plateau region 28 terminate in respective transverse baffles 42, 43 and 44 which are integrally joined to the bottom surfaces and opposing side surfaces of channels 32, 33 and 34, respectively. Each of the baffles 42, 43 and 44 extends from the bottom surface of the respective channel 32, 33 and 34 a distance which is less than the depth thereof, and terminates in an edge surface having centrally disposed therein a longitudinally oriented groove 46, 47 and 48, respectively. Opposing end portions of the channels 32, 33 and 34 outline open end portions of respective contact receiving holes 50, 51 and 52 which extend from the bottom surfaces of channels 32, 33 and 34, respectively, through the contact support wall 26 and into communication with cavity 24 in housing 12.

Each of the contact receiving holes 50, 51 and 52 may be provided with a respective generally rectangular configuration having opposing relatively longer side surfaces disposed substantially coplanar with respective opposing side surfaces of the channels 32, 33 and 34, respectively. Also, each of the generally rectangular holes 50, 51 and 52 may have one of its relatively shorter side surfaces disposed substantially coplanar with the adjacent end surface of the respective channel 32, 33 and 34. The opposing relatively shorter side surfaces of the holes 50, 51 and 52 have respective central portions from which protrude integrally ripple-like projections 53, 54 and 55, respectively. The ripple-like projections 53, 54 and 55, which are dimensionally similar to one another, extend linearly from the open ends of respective holes 50, 51 and 52 adjacent the bottom surfaces of channels 32, 33 and 34, respectively, to the opposing open ends of the respective holes 50, 51 and 52 adjacent the cavity 24.

In central channel 33, there is disposed in longitudinally spaced relationship between the baffle 43 and the contact receiving hole 51 a first pair of opposing ripple-like projections, 57 and 58, respectively, and a second pair of opposing ripple-like projections, 59 and 60, respectively. The projections 57 and 59 protrude integrally from the adjacent side surface of ridge 35 and from the coplanar side surface of channel 33. Projections 58 and 60 protrude integrally from the adjacent side surface of ridge 36 and from the coplanar side surface of channel 33. The projections 57–60, which are radially similar to one another and to the respective projections 53–55, extend orthogonally with respect to the axial centerline of channel 32 from adjacent the opening between respective ridges 35 and 36 to the full depth of channel 32. Opposing projections 57 and 58 terminate in respective aligned end portions of a trough-like slot 61 recessed in the bottom surface of channel 33 and extending transversely thereof. The opposing projections 59 and 60 terminate in respective aligned end portions of a trough-like slot 62 recessed in the bottom surface of channel 33 and extending transversely thereof. The opposing ripple-like projections 57–58 have respective crest portions spaced a predetermined distance apart; and the opposing ripple-like projections 59–60 have respective crest portions spaced a similar predetermined distance apart.

In channel 32, there is disposed in longitudinally spaced relationship between the baffle 42 and the contact receiving hole 50 a first pair of opposing ripple-like projections 63 and 64, respectively, and a second pair of opposing ripple-like projections, 65 and 66, respectively. The projections 63 and 65 protrude integrally from the adjacent side surface of channel 32, and extend orthogonally to the linear channel 32 from the opening thereof to the full depth of channel 32. Projections 64 and 66 protrude integrally from the adjacent surface 32 and the coplanar side surface of 37. Thus, the projections 64 and 66 extend orthogonally to the linear channel 32 from adjacent the outer surface of ridge 37 to the full depth of channel 32. The opposing projections 63 and 64 terminate in respective aligned end portions of a trough-like slot 67 recessed in the bottom surface of channel 32 and extending transversely thereof. Also, the opposing projections 65 and 66 terminate in respective aligned end portions of a trough-like slot 68 recessed in the bottom surface of channel 32 and extending transversely thereof. Projections 63–66 are radially similar to one another and to projections 57–60, respectively. The opposing projections 63–64 have respective opposing crest portions spaced a predetermined distance apart; and the opposing projections 65–66 have respective opposing crest portions spaced a similar predetermined distance apart.

Moreover, in channel 34, there is disposed in longitudinally spaced relationship between the baffle 44 and the contact receiving hole 52 a first pair of opposing ripple-like projections 69 and 70, respectively, and a second pair of opposing ripple-like projections, 71 and 72, respectively. The projections 69 and 71 protrude integrally from the adjacent side surface of channel 34 and from the coplanar side surface of ridge 38. Accordingly, the projections 69 and 71 extend orthogonally with respect to the linear channel 34 from the outer surface of ridge 38 to the full depth of channel 34. Projections 70 and 72 protrude integrally from the adjacent side surface of channel 34, and extend orthogonally to the linear channel 34 from the opening thereof to the full depth of channel 32. The opposing projections 69 and 70 terminate in respective aligned end portions of a trough-like slot 73 recessed in the bottom surface of channel 34 and extending transversely thereof. Also, the opposing projections 71 and 72 terminate in respective aligned end protions of a trough-like slot 74 recessed in the bottom surface of channel 34 and extending transversely thereof. Projections 69–72 are radially similar to one another and to the projections 57–60, respectively The opposing projections 69–70 have respective opposing crest portions spaced a predetermined distance apart; and the opposing projections 71–72 have respective opposing crest portions spaced a similar predetermined distance apart.

Referring again to FIGS. 1 and 2, the connector 10 includes three right-angle contact members 76, 77 and 78, respectively, which are made of electrically conductive material, such as a brass alloy material, for example. The contact members 76, 77 and 78 have respective predetermined thicknesses which are similar to one another, and are produced by a suitable manufacturing process, such as stamping, for example. Contact members 76, 77 and 78 are provided with respective contact engaging portions, each of which comprises a cantilevered blade-like arm, 80, 81 and 82, respectively, having a generally rectangular cross-section. The contact engaging arms 80, 81 and 82 have respective height dimensions which are similar to one another and are related to the assembly of the respective contact members 76, 77 and 78 in housing 12 in accordance with this invention. Also, each of the contact engaging arms 80, 81 and 82 has a leading distal end portion provided with tapering sides.

Opposing proximal end portions of the respective contact engaging arms 80, 81 and 82 are integrally joined to respective proximal end portions of orthogonal channel engaging arms 84, 85 and 86, respectively, each of which has a generally rectangular cross-section. The contact member 77 may comprise an electrical ground member having the proximal end portion of its contact engaging arm 81 provided with an integral extension 83 which protrudes rearwardly of the channel engaging arm 85. Also, the extension 83 may have extended through its thickness a conductor receiving hole 87 whereby an external conductor (not shown) may be electrically connected, as by soldering, for example to the contact member 77. The channel engaging arms 84, 85 and 86 are disposed in substantially coplanar relationship with the orthogonal contact engaging arms 80, 81 and 82, respectively. Channel engaging arms 84, 85 and 86 have respective cross-sections which are dimensionally similar to one another. Each of the channel engaging arms 84, 85 and 86 has a predetermined width as well as a predetermined thickness related to assembly of the respective contact members 76, 77 and 78 in housing 12 in accordance with the invention. Also, each of the channel engaging arms 84, 85 and 86 has a distal end portion integrally joined to a proximal end portion of a respective aligned terminal 88, 89 and 90 which has a generally cylindrical configuration.

In assembly, the contact members 76, 77 and 78 have the distal end portions of their respective contact engaging arms 80, 81 and 82 aligned, as by means of fixturing in an automatic feed press (not shown), for example, with the respective contact receiving holes 50, 51 and 52 in the plateau region 28 of housing 12. Also, the contact members 76, 77 and 78 have side surfaces of the respective channel engaging arms 84, 85 and 86 adjacent housing 12 aligned with the respective contact receiving channels 32, 33 and 34 in plateau region 28. Moreover, the contact members 76, 77 and 78 have the proximal end portions of respective terminals 88, 89 and 90 aligned with the grooves 46, 47 and 48, respectively, in the baffles 42, 43 and 44, respectively. The contact members 76, 77 and 78 may be installed in the housing 12 simultaneously or sequentially, as desired.

The contact engaging arms 80, 81 and 82 have their respective tapered distal end portions inserted into the contact receiving holes 50, 51 and 52, respectively, and are pressed forcefully therein by respective longitudinally directed pressures exerted on the contact engaging portions. The generally rectangular configurations of the respective holes 50, 51 and 52 conform closely to the generally rectangular cross-sections of the respective contact engaging arms 80, 81 and 82. Consequently, there is less than five thousandths of an inch clearance between the side surfaces of holes 50, 51 and 52 respectively, and the corresponding side surfaces of the contact engaging arms 80, 81 and 82, respectively. Moreover, each of the ripple-like projections 53, 54 and 55 protrudes integrally from the adjacent side surface of holes 50, 51 and 52, respectively, a sufficient distance, such as six to ten thousandths of an inch, for example, for interference pressure engagement with the respective contact engaging arms 80, 81 and 82. As a result, the tapered distal end portions of the respective contact engaging arms 80, 81 and 82 advance into gradually increasing pressure engagement with the ripple-like projections 53, 54 and 55, respectively. The trailing, full height portions of the contact engaging arms 80, 81 and 82, respectively, compress the ripple-like projections 53, 54 and 55, respectively, sufficiently to permit a sliding passage through the holes 50, 51 and 52, respectively. The compressed ripple-like projections 53, 54 and 55 exert respective counter pressures on the adjacent side surfaces of contact engaging arms 80, 81 and 82, respectively, thereby pressing the respective opposing side surfaces thereof against the adjacent side surfaces of the holes 50, 51 and 52, respectively.

Thus, the contact engaging arms 80, 81 and 82 of contact members 76, 77 and 78, respectively, are pressed longitudinally through the contact receiving holes 50, 51 and 52, respectively, to emerge in laterally spaced relationship with one another in cavity 24. As a result, the channel engaging arms 84, 85 and 86 have their respective leading side edges adjacent housing 12 inserted laterally into the aligned contact receiving channels 32, 33 and 34, respectively, and press-fitted therein. The channel engaging arms 84, 85 and 86 are pressed laterally until their respective leading side edges abut the bottom surfaces of channels 32, 33 and 34, respectively, and their respective opposing side edges are substantially flush with the outer surfaces of ridges 35–38, respectively.

Channels 32, 33 and 34 have respective widths which conform closely to the respective thicknesses of channel engaging portions 84, 85 and 86. Consequently, there is less than five thousandths of an inch clearance between the side surfaces of channels 32, 33 and 34, respectively, and the adjacent side surfaces of channel engaging arms 32, 33 and 34, respectively. Moreover, each of the respective ripple-like projections 57–60, 63–66 and 69–72 protrude integrally from the adjacent side surface of the respective channel a sufficient distance, such as six to ten thousandths of an inch, for example, for interference pressure engagement with the adjacent sides of the channel engaging arms 84, 85 and 86, respectively.

However, unlike the distal end portions of contact engaging arms 80, 81 and 82, respectively, the leading side edges of channel engaging arms 84, 85 and 86, respectively, are not tapered, and form substantially right angles with the adjacent side surfaces thereof. Consequently, the leading side edges of channel engaging arms 84, 85 and 86, respectively, shave off the interfering portion of the ripple-like projections 57–60, 63–66 and 69–72, respectively, and push the shaved material (not shown) toward the aligned end portion of trough-like slots 61–62, 67–68 and 73–74, respectively. Thus, the slots 61–62, 67–68 and 73–74 are disposed in the channels 32, 33 and 34, respectively, for receiving the material shaved from aligned ripple-like projections 57–60, 63–66 and 69–72, respectively, and allowing the leading side edges of channel engaging arms 84, 85 and 86, respectively, to bottom in the channels 32, 33 and 34, respectively. The opposing side edges of channel engaging arms 84, 85 and 86, respectively, then are substantially flush or slightly below flush with the terminating surfaces of ridges 35–38, respectively. Simultaneoulsly with the leading side edges of channel engaging arms 88, 89 and 90, respectively, bottoming in the respective channels 32, 33 and 34, the proximal end portions of terminals 88, 89 and 90 are pressed into the aligned grooves 46, 47 and 48, respectively. As a result, opposing distal end portions of terminals 88, 89 and 90, respectively, extend from the surface 31 and externally of housing 12.

The remaining portions of the respective ripple-like projections 57–60, 63–66 and 69–72 still integrally joined to adjacent side surfaces of the respective channels 32, 33 and 34 pressed against the adjacent side surfaces of channel engaging arms 84, 85 and 86, respectively. As a result, the contact members 76, 77 and 78 including the respective contact engaging arms 80, 81 and 82 thereof are disposed in respective desired planes which are laterally spaced apart. Also, the ripple-like projections 53, 54 and 55 pressing the contact engaging arms 80, 81 and 82, respectively, against the opposing side surfaces of holes 50, 51 and 52, respectively, position the contact engaging arms within the respective desired planes. Consequently, the contact engaging arms 80, 81 and 82 are suitably located within the cavity 24 for electrical engagement with respective contact members of a mating electrical connector (not shown). Furthermore, the ripple-like projections 53–55 exerting pressure on the contact engaging arms 76–78, respectively, and the ripple-like projections 57–60, 63–66 and 69–72 exerting pressure on the channel engaging arms 84–86, respectively, serve to resist a dislodging pressure and hold the contact members 76–78, respectively, firmly in place. For example, it has been found that, at this stage of assembly, any one of the contact members 76, 77 and 78 is enabled to withstand a pressure of twenty pounds applied in a direction opposite to the direction of insertion without moving from the desired plane in cavity 24 or withdrawing from the respective channels 32, 33 and 34.

Figure 5:
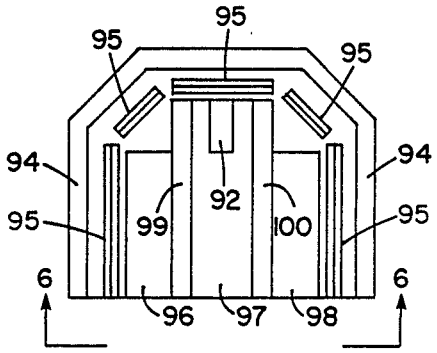
FIG. 5 is an elevational view of the inner surface of the cover shown in FIG. 1.
Figure 4:
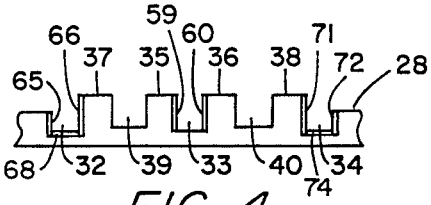
FIG. 4 is a fragmentary cross-sectional view taken along the line 4—4 shown in FIG. 3 and looking in the direction of the arrows.
Figure 6:
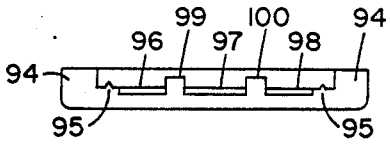
FIG. 6 is an end view of the cover taken along the line 5—5 shown in FIG. 4 and looking in the direction of the arrows.

As shown more clearly in FIGS. 5 and 6, there is extended through the thickness of cover 30 an aperture 92 having a generally rectangular configuration which is similar to the cross-section of extension 83 and is slightly larger in size. Consequently, the extension 83 of contact engaging arm 81 passes slidably through the aperture 92 when the cover 30 is being fitted over the plateau region 28. The inner surface of cover 30 adjacent housing 12 includes a terminating surface of a rim 94 which has an inner periphery conforming closely to the outer periphery of plateau region 28 and defining an area of slightly larger size. Thus, when the cover 30 is pressed over the plateau region 28, the plateau region 28 fits within the inner periphery of rim 94; and the terminating surface of rim 94 is disposed adjacent the outer surface of contact support wall 26.

Spaced laterally inward of the rim 94 is a series of ridge-like protrusions 95 which extend integrally from the inner surface of cover 30 and have respective cross-sections which are generally triangular. The protrusions 95 have mutually spaced end portions and are disposed in a configuration which is generally similar to the inner periphery of rim 94. Thus, when the cover 30 is pressed over the plateau region 28, the peak portions of the respective ridge-like projections 95 are pressed against marginal surface portions of the plateau region 28 adjacent its outer periphery. Consequently, a conventional ultrasonic bonding machine (not shown) may have the tip of its vibrating horn pressed against the outer surface of cover 30 and vibrated at ultrasonic frequencies to cause the respective ridge-like protrusions 95 to melt and weld the cover 30 to the outer surface of plateau region 28.

Within the configuration formed by the ridge-like protrusions 95, the aperture 92 is disposed in a central recessed area 97 which is generally rectangular. The recessed area 97 is disposed between two coextensive ridges, 99 and 100, respectively, which extend integrally from the inner surface of cover 30 respective similar predetermined distances. Ridges 99 and 100 are disposed between two recessed areas, 96 and 98, respectively, which have respective similar rectangular configurations. The recessed areas 96–98 have respective similar depths measured from the inner surface of cover 30; and the recessed area 97 has a greater length than the lengths of recessed areas 96 and 98, respectively. Thus, when the cover 30 is pressed over the plateau region 28, the central recessed area 97 of cover 30 receives therein the trailing side edge portion of channel engaging arm 81 disposed in the central channel 33 and the two ridges 35 and 36 which are disposed on either side of the channel 33. Ridges 99 and 100 of cover 30 extend into respective recessed areas 39 and 40 in the plateau region 28. The recessed area 96 of cover 30 receives therein the trailing side edge portion of channel engaging arm 80 disposed in channel 32 and the juxtaposed ridge 37 of plateau region 28. Also, the recessed area 98 of cover 30 receives therein the trailing side edge portion of channel engaging arm 83 disposed in channel 34 and the juxtaposed ridge 38 of plateau region 28.

Preferably, the ridges 35–38 extend from the outer surface of plateau region 28 respective similar distances which are greater than the distances ridges 99 and 100 extend from the inner surface of cover 30. As a result, when the cover 30 is pressed over the plateau region 28, the ridges 35–39 will abut the bottom surfaces of the recessed areas 96–98, respectively, before the ridges 99–100 of cover 30 will reach the bottoms of respective recessed areas 39 and 40 in the plateau region 28. Accordingly, when the cover 30 is being ultrasonically bonded to the outer surface of plateau region 28, the ridges 35–38 may have their outer edge portions function in a manner similar to that of the respective protrusions 95. Thus, due to the ultrasonic vibrations and accompanying pressure transmitted to the cover 30 by a conventional ultrasonic bonding machine (not shown), the outer edge portions of the respective ridges 35–38 melt and weld to the cover 30. As a result, the ultrasonically bonded cover 30 aids the ripple-like projections 53–55, 57–60, 63–66 and 69–72 in resisting any movement of the contact members 76–78 from desired positions in the respective planes due to insertion forces or the like. For example, it has been found that, at this stage of assembly, the fully installed contact members 76–78 with the aid of the installed cover 30 are capable of withstanding respective forces of eighty pounds per square inch applied in directions opposite to the insertion directions of the contact members.

From the foregoing, it will be apparent that all of the objectives have been achieved by the structures and methods described herein. It also will be apparent, however, that various changes may be made by those skilled in the art without departing from the spirit of the inventive subject matter, as expressed in the appended claims. It is to be understood, therefore, that all matter shown and described is to be interpreted as illustrative and not in a limiting sense.

What is claimed is:

1. An electrical connector comprising:

a dielectric body including a housing having therein a cavity and having a wall defining a peripheral portion of said cavity, said wall having respective first pluralities of surface portions defining respective first opening means extended through said wall and into communication with said cavity for permitting passage of respective first portions of respective contact members through said wall and into said cavity, each of said respective first pluralities of surface portions including a respective first surface portion of said wall having a respective first integral projection extended into said respective first opening means; and said wall having an outer surface with respective second pluralities of surface portions defining respective second opening means in said outer surface for receiving therein respective second portions of said respective contact members, each of said respective second pluralities of surface portions including respective second surface portion of said wall having an integral projection extended into said respective second opening means.

2. An electrical connector as set forth in claim 1 wherein said respective first opening means comprise respective through-holes extended through said wall and said first integral projections comprise respective ripple-like projections protruding into said respective through-holes and extending linearly from said outer surface of said wall to said cavity in said housing.

3. An electrical connector as set forth in claim 2 wherein said respective second opening means comprise respective channels having respective end portions communicating with said respective through-holes extended through said wall, each of said channels having opposing side surfaces with respective integral projections comprising respective ripple-like projections extended into said respective channels.

4. An electrical connector as set forth in claim 3 wherein said outer surface of said wall extends substantially orthogonally to said through-holes, and said channels extend substantially linearly in said outer surface of said wall from said respective through-holes extended through said wall.

5. An electrical connector as set forth in claim 4 wherein said dielectric body includes a plate-like cover having means for fitting over said respective through-holes and said respective channels, and for being fixedly secured to said outer surface of said wall.

6. The method of assembling contact members into a dielectric body of a connector comprising the steps of:

(a) press-fitting respective contact engaging portions of said contact members into respective through-holes extended through a wall of said dielectric body;

(b) compressing respective ripple-like projections in said respective through-holes;

(c) pressing said respective contact engaging portions of said contact members against respective opposing surfaces of said through-holes;

(d) press-fitting respective channel engaging portions of said contact members in respective channels in an outer surface of said wall of said dielectric body;

(e) shaving off opposing crest portion of respective pairs of ripple-like projections protruding outwardly from respective opposing side surfaces of said respective channels;

(f) pushing said crest portion shavings ahead of said respective channel engaging portions into trough-like slots in respective bottom surfaces of said respective channels; and (g) bottoming said respective channel engaging portions on said respective bottom surfaces of said respective channels.

7. An electrical connector comprising:

a dielectric housing comprising an open ended cavity having a back wall with a plurality of holes communicating from said cavity through said back wall to a back surface of said back wall, said back surface having a plurality of channels each leading to a respective one of said holes;

a plurality of electrical contact members each comprising a first arm positioned in a respective one of said channels on said back surface of said back wall and a second arm perpendicularly connected to said first arm, said second arm extending through a respective one of said holes into said cavity to provide a male terminal for said connector in said cavity; and means for retaining each of said contact members in each of said respective channels, said retaining means comprising at least one rigid projection from a side of said channel to provide an interference fit for said contact member in said channel.

8. An electrical connector as recited in claim 7 further comprising a cover connected to said housing encasing portions of said plurality of said first arms between said cover and said back surface.

9. An electrical connector as recited in claim 8 further comprising an ultrasonic bond between said cover and said dielectric housing.

10. The connector as recited in claim 7 wherein said channels have rippled side walls spaced for press fitting said first arms of said respective contact members and for retaining said second arms in a predetermined alignment within said cavity.

11. The method of fabricating connectors comprising the steps of:

providing a dielectric housing comprising an open ended cavity having a back wall with a plurality of holes communicating from said cavity through said back wall to a back surface of said back wall, said back surface having a plurality of channels each leading to a respective one of said holes;

providing a plurality of electrical contact members each comprising a first arm and a perpendicularly connected second arm;

inserting said second arms of said respective electrical contact members through respective ones of said holes and into said cavity; and press fitting said first arms of said respective electrical contact members into respective channels on said back surface wherein said electrical contact members are retained by said dielectric housing and said second arms are arranged in a predetermined alignment within said cavity.

12. The method recited in claim 10 further comprising the step of ultrasonically bonding a cover over portions of said first arms of said electrical contact members on the back surface of said housing.

* * * * *